US005791313A

United States Patent [19]

Pugh

[11] Patent Number: 5,791,313

[45] Date of Patent: Aug. 11, 1998

[54] PULSE SENSING SPEED CONTROL FOR INTERNAL COMBUSTION ENGINES

[75] Inventor: Jason Pugh, Fond du Lac, Wis.

[73] Assignee: Brunswick Corporation, Lake Forest, Ill.

[21] Appl. No.: 883,207

[22] Filed: Jun. 26, 1997

[51] Int. Cl.[6] ..... F02D 41/16

[52] U.S. Cl. ..... 123/339.1; 123/378; 123/389

[58] Field of Search ..... 123/73 R, 339.1, 123/378, 389

[56] References Cited

U.S. PATENT DOCUMENTS

| | | | |
|---|---|---|---|
| 2,575,384 | 11/1951 | Horton | 123/339.1 |
| 3,195,525 | 7/1965 | Beck | 123/378 X |
| 3,287,007 | 11/1966 | Schoeppach | 123/389 X |
| 4,196,704 | 4/1980 | Cook | 123/339.1 |
| 4,590,896 | 5/1986 | Wissmann et al. | 123/378 X |

*Primary Examiner*—Tony M. Argenbright
*Attorney, Agent, or Firm*—Andrus, Sceales, Starke & Sawall

[57] ABSTRACT

An idle speed control for an internal combustion engine has a crankcase adapted to be connected to a fuel metering device used to selectively deliver fuel to the engine in response to pressurized air pulses generated in the engine. The idle speed control includes a vessel having a pressure actuated member movably mounted therein to define a first chamber and a second chamber. The second chamber is provided with a biasing device acting on one side of the pressure actuated member and the first chamber admits the pressurized air pulses acting on an opposite side of the pressure actuated member and controllably leaking a portion of the pulses therefrom. The idle speed is controlled by a leak-down rate of pressurized air pulses released from the second chamber.

17 Claims, 2 Drawing Sheets

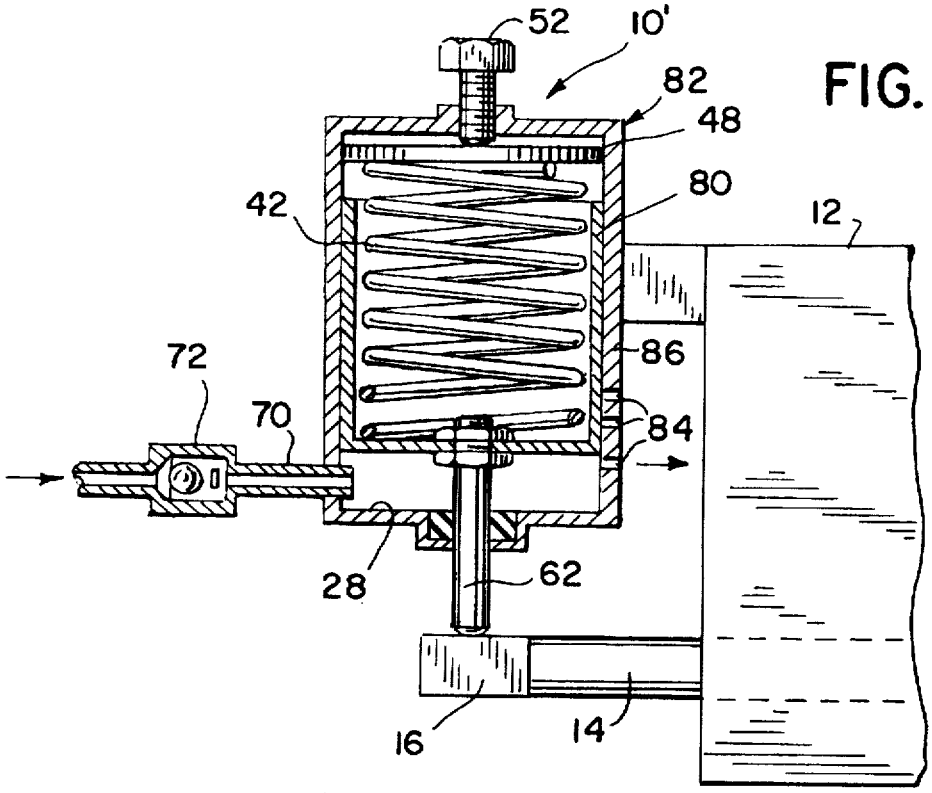
FIG. 3
FIG. 4
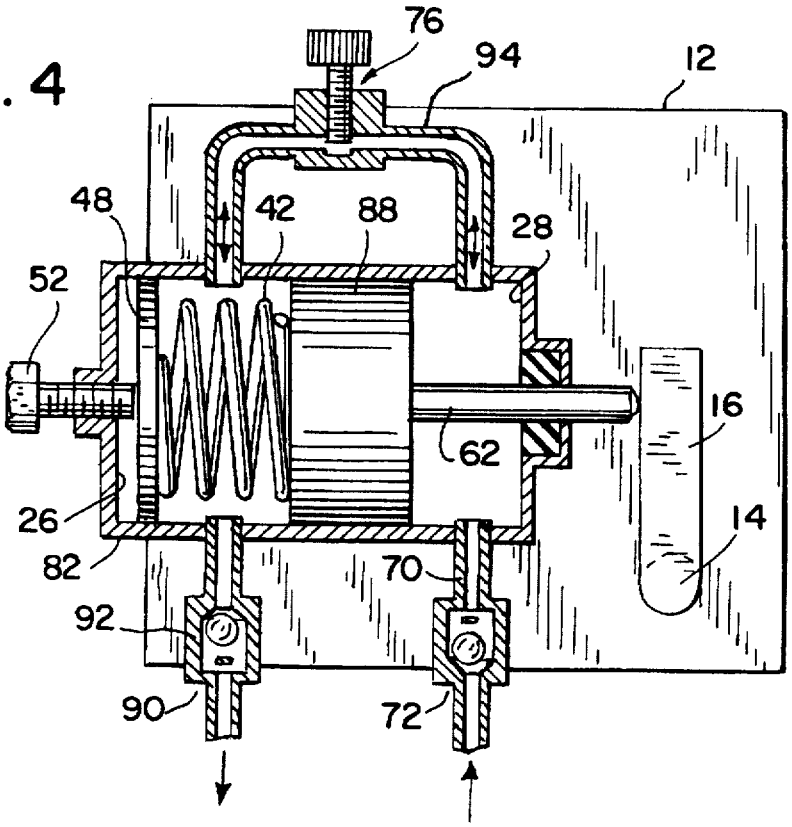

PULSE SENSING SPEED CONTROL FOR INTERNAL COMBUSTION ENGINES

BACKGROUND OF THE INVENTION

This invention relates broadly to mechanical fuel metering in internal combustion engines and, more particularly, pertains to an idle speed control which is driven by pressurized signals or pulses generated in the engine.

As emission reduction, fuel economy and customer expectations for constantly improving running quality of fuel injected internal combustion engines continue, it becomes evident that devices are required which can constantly adjust idle speed, since the lean mixtures desired will not run well, or sometimes not at all, with fixed settings. This is especially true as operating conditions vary, or as engine demand varies due to accessories that may be in use. The contribution to total emissions is significant because of the large amount of time most engines spend at idle or very low speeds.

The direct injected engines which are mechanically injected run fully stratified at idle and off-idle. This means that the mixtures are so lean that the engine will not run without some sort of idle control. While typical engines can run between 14–20 parts of air to 1 part fuel, direct injected engines (mechanical and electronic) can run at 80–100 parts air to 1 part fuel. This results in vastly improved fuel economy and emissions. These extreme measures require the fueling level to be constantly and quickly adjusted to maintain the excellent stability for which direct injection engines are known.

Fully electronic, direct injected engines perform fuel adjustment electronically by simply varying the amount of fuel injected by the injector. Port injected two or four-stroke, mechanical injection or carbureted engines need a device to mechanically adjust the fueling, throttle position or both. Some applications employ a fuel metering pump in conjunction with an electronic stepper motor to do this task. Fuel metering pumps are mechanical supply devices used in conjunction with fuel injected internal combustion engines to increase fuel pressure for delivery to a direct fuel injector, and to meter an appropriate amount of fuel for each cycle of cylinder in the engine. The fuel metering pump employs an internal piston which forces a smaller piston or plunger rod attached to it back and forth by using crankcase pulses existing in every two-stroke engine. Since the engine requires different fueling levels for different speed and load conditions, the stroke of the plunger rod must be adjustable. The correct quantity of fuel is determined by a small displacement of the plunger rod which results in injection at once per cycle. The amount of fuel injected at each cycle is controlled by varying the stroke of the plunger rod. This reciprocal motion is achieved through the engagement of a concentric button cam on the top of each plunger rod with, a cam mounted for rotation on a camshaft which is connected to the external linkage of the throttle to receive driver demand. The fuel metering pump utilizes a conventional stepper motor to act on the throttle linkage for start-up and idle control. A stepper motor is an electronically controlled motive device that has its own plunger that can be moved in and out an incremental amount in response to the engine control module (ECM). The ECM receives signals from various engine sensors and changes fuel volume by sending a signal to the stepper motor so as to rotate the camshaft and its cam relative to the respective button cam on the top of each plunger rod. Rotating the cam against a throttle return spring limits the stroke that the plunger rod can move, thereby limiting fuel quantity which is ultimately delivered at a high pressure into an air space in the direct fuel injector.

Use of the stepper motor in the above-described fueling control presents several disadvantages. For instance, stepper motors have recognized limitations in power and speed which need to be overcome by specialized linkage designs before suitable responsiveness can be attained. Stepper motors also add considerable expenditures on applications which are cost sensitive such as small utility engines, motor bikes and marine engines. Because of their inherent size, many engines do not have the electrical energy to drive the stepper motor so that additional demand is required of the system. In addition, stepper motors have exhibited poor reliability in adverse environments where corrosion resistance and vibration tolerance are required. In some applications, the stepper motor loses track of its internal position so that its reliability is seriously affected.

A further particularly vexing problem arises when providing speed control for two-cycle engines which do not have significant intake manifold vacuum to run control accessories, such as four-cycle type vacuum pots. These are known control devices typically plugged into the intake manifold of a four-stroke engine and used in automotive applications to slow deceleration of the throttle when the driver lets up quickly on the accelerator so as to prevent stalling and backfires. Unfortunately, these devices are not designed to control idle and off-idle running of the engine.

Accordingly, it is desirable to provide an accurate idle speed control for an internal combustion engine in which fuel is selectively delivered to the engine in response to pressurized pulses generated in the crankcase of the engine. It is also desirable to provide a speed control which varies the fueling rate particularly at idle and low speeds without the need for a stepper motor and an ECM. It is further desirable to provide a quick responding idle speed control for an engine system having reduced electrical power. It remains desirable to provide a user-adjustable idle speed control having a rugged, simple design for optimum reliability.

BRIEF SUMMARY OF THE INVENTION

The present invention advantageously provides an extremely reliable pulse-sensing idle speed control based on employing a calibration spring and a controlled leak-down of captured pulses to position a plunger which actuates a control linkage of a fuel metering device.

It is one object of the present invention to provide an accurate idle speed control which may be employed for a wide variety of applications involving internal combustion engines.

It is also an object of the present invention to provide an adjustable idle speed control which is especially beneficial in small engines, or marine engines where a constant speed is required for trolling while fishing and the end user can control speed without affecting engine calibration/set-up.

It is a further object of the present invention to provide an idle speed control wherein no stepper motor or computer control is necessary.

It is a further object of the present invention to provide an idle speed control wherein use of crankcase pulses provides lubrication of the speed control.

It is a still further object of the present invention to provide an idle speed control having a corrosion/vibration resistant design.

It is yet a further object of the present invention to provide an idle speed control having an internal component design which provides for a fast reacting, more responsive device.

In accordance with one aspect of the present invention there is contemplated an idle speed control for an internal combustion engine having a crankcase adapted to be connected to a fuel metering device used to selectively deliver fuel to the engine in response to pressurized air pulses generated in the engine. The idle speed control includes a pulse sensing arrangement cooperable with the fuel metering pump to change engine idle speed by balancing the pressurized air pulses and a release of the pressurized air pulses relative to an opposing biasing force.

In another aspect of the invention there is contemplated an idle speed control for an internal combustion engine having a crankcase adapted to be connected to a fuel metering device used to selectively deliver fuel to the engine in response to pressurized air pulses generated in the engine. A vessel has a pressure actuated member movably mounted therein to define a first chamber and a second chamber, the second chamber being provided with a biasing device acting on one side of the pressure actuated member and the first chamber admitting pressurized air pulses acting on an opposite side of the pressure actuated member and leaking a portion of the pulses therefrom, the idle speed being controlled by the leak-down rate of pressurized air pulses released from the first chamber. A first passageway is provided for admitting the pressurized air pulses into the first chamber, the inlet being provided with a check valve. A second passageway is included for admitting negative pressurized air pulses into the second chamber.

In yet another aspect of the present invention, there is contemplated a pressure actuated idle speed control for an internal combustion engine including a crankcase adapted to be connected with a fuel metering device assembly to deliver fuel at a predetermined pressure and volume responsive to pressurized pulses generated in the crankcase. A vessel is provided for receiving the pressurized air pulses, and a pressure actuated member is movably mounted in the vessel and responsive to at least one set of air pulses acting on at least one side thereof. The pressure actuated member has a plunger extending from the one side outwardly of the vessel for engagement with the fuel metering device. A biasing device is mounted on the vessel and acts on an opposite side of the pressure actuated member. A leak-down arrangement is provided in the vessel for releasing the pressurized air pulses therefrom. When the idle speed is low, the pressurized air pulses act on the one side of the pressure actuated member. Pressurized air pulses acting on the one side of the pressure actuated member are released from the vessel via the leak-down arrangement and the biasing device forces the plunger against a camshaft to increase the fueling rate at idle speed. When the idle speed becomes excessively high, the pressurized air pulses acting on the one side of the plunger actuated member overcome the biasing device and withdraw the plunger from the camshaft to reduce the fueling rate and the idle speed. In one embodiment, the pressure actuated member is a diaphragm; in another embodiment, the pressure actuated member is a sliding piston. The leak-down arrangement includes an adjustable needle valve and the vessel may be formed with a plurality of leak-down holes selectively uncovered adjacent the sliding piston.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings:

FIG. 3 shows a second alternative embodiment of the invention; and

FIG. 4 shows a third alternative embodiment of the invention.

DETAILED DESCRIPTION OF THE INVENTION

Figure 1:
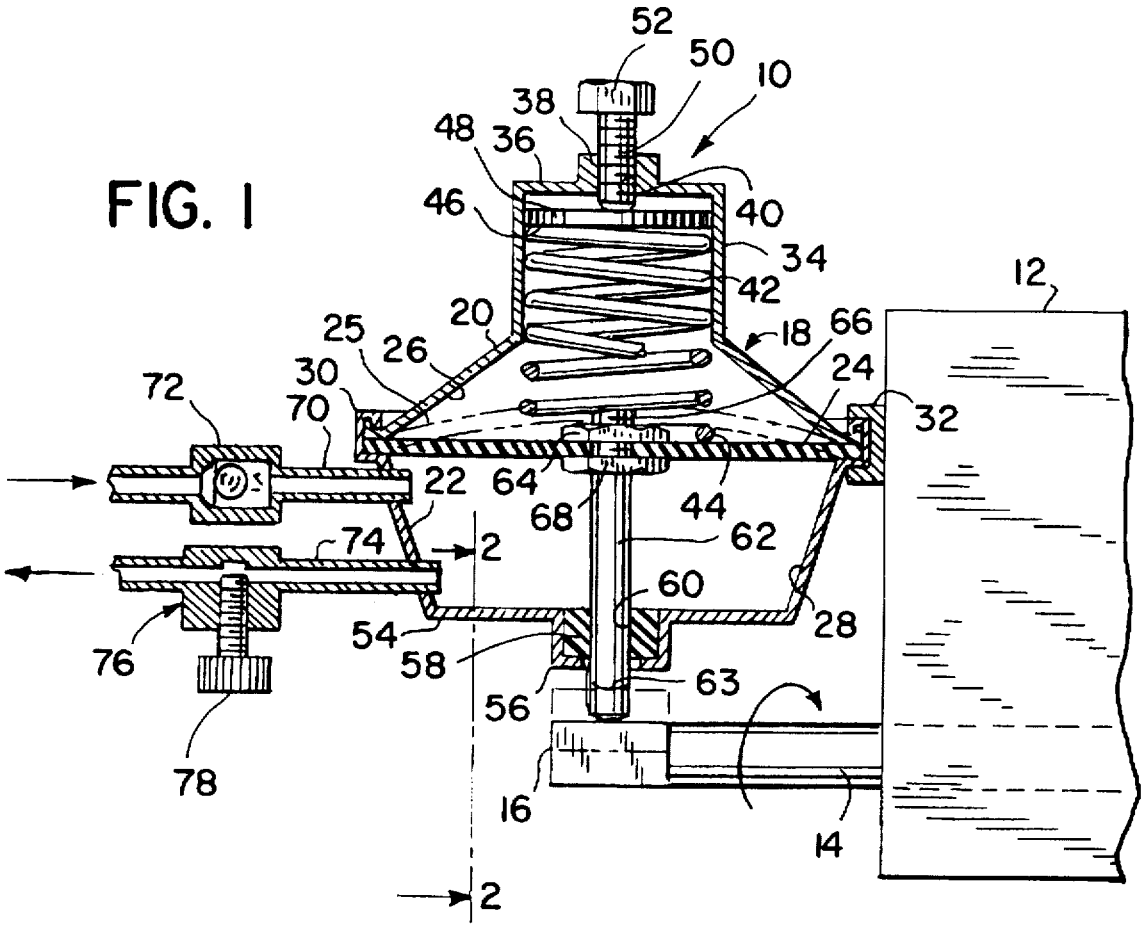
FIG. 1 is diagrammatic view with parts broken away and in cross-section, showing the pulse sensing idle speed control embodying the present invention.

Referring now to FIG. 1, an idle speed control 10 embodying the present invention is adapted to be used in conjunction with a conventional fuel metering device 12 which, in turn, delivers a desired amount of fuel at a predetermined time and pressure to the combustion chamber of an internal combustion engine. Although not shown, it is understood that the engine has a crankcase from which pressurized air pulses or signals are generated. That is, pressure changes from a positive pressure (above atmospheric) to a negative pressure (below atmospheric) as the engine rotates and the piston in the cylinder moves up and down. It is this same pressure change that moves the fuel mixture in a two-cycle engine from the crankcase to the combustion chamber where it is compressed and burned. These pressure signals which are communicated to the fuel metering device 12 as is well known can be an indicator of engine speed and, as will be appreciated hereafter, can provide the power required to operate the idle speed control 10.

It should also be understood that the standard structure of the fuel metering device 12 though not illustrated includes an internal piston which forces a plunger rod attached to it back and forth by using the crankcase pulses discussed above. The amount of fuel injected at each cycle of the engine is controlled by varying the stroke of the plunger rod which selectively opens and closes communication between a fuel inlet and a fuel outlet. Reciprocal movement of the plunger rod is achieved through the engagement of a button cam on the top of each plunger rod with a cam mounted for movement on a rotatable camshaft 14. The outer end of camshaft 14 is provided with a flat paddle or lever 16, FIG. 2, which carries a biasing force from a spring associated with the camshaft 14. In prior art designs, the lever 16 is connected directly to the throttle linkage or is engaged by a linearly movable shaft of a stepper motor responsive to a computerized engine control module (ECM). The present invention resides in recognizing the deficiencies of these prior art arrangements in providing an accurate speed control which is particularly useful in idle and very low speed conditions.

In accordance with the invention, the idle speed control 10 includes a rigid vessel 18, FIG. 1, having a top portion 20 and a bottom portion 22. Clamped between the top portion 20 and the bottom portion 22 is a flexible, pressure actuated member 24, preferably in the form of a rubber diaphragm, which divides the vessel 18 into a top chamber 26 and a bottom chamber 28. The vessel 18 has a circumferential lip 30 which is slidably or otherwise supported in a bracket 32 projecting from the fuel metering device 12. The top portion 20 of the vessel 18 is formed with an upwardly rising, generally cylindrical section 34 provided on its uppermost surface 36 with a raised boss 38 through which an internally threaded throughbore 40 is formed. A calibrated coil compression spring 42 is positioned in the cylindrical section 34 so that its bottom coil end 44 will be supported on the upper side of the diaphragm 24. The top coil end 46 of spring 42 is disposed against the underside of a circular pressure plate 48, the top side of which is exerted downwardly by a shaft 50 of an adjustable screw member 52 threaded into the throughbore 40. Rotating the screw 52 will create a variable biasing force of the spring 42 relative to the diaphragm 24.

The bottom surface 54 on the bottom portion 22 of the vessel 18 is formed with a sunken step 56 into which a seal 58 with an opening 60 is placed. A generally cylindrical, elongated plunger 62 having substantially the same longitudinal axis as the screw 52 passes through the center of diaphragm 24, and is held suspended therefrom by an upper nut 64 screwthreaded on a threaded top segment 66 of the plunger 62 against the upper side of the diaphragm 24 and a lower nut 68 screwthreaded on the top segment 66 against the lower side of the diaphragm 24. The plunger 62 depends downwardly through the bottom chamber 28 and slides back and forth through the opening 60 in the seal 58 for selective engagement at its lower end with the camshaft lever 16. A first conduit 70 extends outwardly from the bottom portion 22 of the vessel 18 and communicates alternating pressurized air pulses or signals generated in the crankcase into the bottom chamber 28. The first conduit 70 is provided with a one-way check valve 72 oriented so as only to permit the emission of these pulses into the bottom chamber 28. A second conduit 74 also extends outwardly from the bottom portion 22 of the vessel 18 and serves to controllably release pressurized air pulses captured in the bottom chamber 28 by means of an adjustable needle valve 76 having a screwthreaded, rotatable adjustment element 78 which selectively allows and blocks communication in the second conduit 74. Pressurized air released through the second conduit 74 may be vented to atmosphere, transferred to an air box or otherwise suitably released from the system.

In use, when the idle speed of the engine is low or at engine start-up, the spring 42 overrides the pressurized air pulses acting on the lower side of the diaphragm 24 since the pulses are leaked out through second conduit 74 and needle valve 76 at a faster rate than they can be built up. The spring 42 thus forces the plunger 62 outwardly against the biased lever 16 to rotate camshaft 14 and increase the fueling, or open the throttle, which thereby desirably speeds up the engine. The engine speed increases until the pressure signals of the engine, the leak-down rate, and the calibrated spring 42 are all in equilibrium and the engine speed is then held constant.

The bleed down rate created by needle valve 76 is constant, and thus when engine speed increases, the pressure builds up on the diaphragm 24 faster than it can be leaked or bled down. The pressurized air pulses push upwardly against the lower side of diaphragm 24 overcoming the force of spring 42 such that diaphragm 24 moves to the phantom line position shown in FIG. 1 at 25. As the diaphragm 24 is flexed, the plunger 62 is withdrawn and the lever 16 on the spring biased camshaft will follow the end of the plunger 62 also as shown in phantom at 17 and 63 in FIGS. 1 and 2. This closes the throttle or adjusts the fuel metering device 12 to decrease the fueling and desirably slow the engine again until the forces of the pressurized air pulses, the leak-down rate and the spring 42 are equalized at the desired RPM of the engine.

Figure 2:
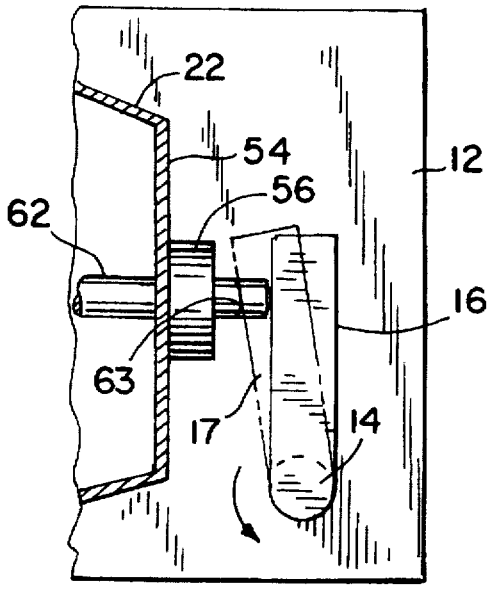
FIG. 2 is a sectional view taken on line 2—2 of FIG. 1.

FIG. 3 depicts a second embodiment of the invention which operates on the same basic principles of the preferred embodiment shown in FIGS. 1 and 2 with the following structural distinctions. Like reference numerals denote like elements above described. In this version, a generally cylindrical, open top piston 80 is slidably mounted for back and forth movement in a generally cylindrical vessel 82 having a plurality of leak-down holes 84 formed in a sidewall 86. The holes 84 thus perform the equivalent leak-down function of the needle valve 76 in FIGS. 1 and 2. As the pressurized air pulses build up in bottom chamber 28, the piston 80 is raised against the force of spring 42, progressively uncovering holes 84 so that the pressurized air pulses can be released according to the size and position of the holes 84.

FIG. 4 represents a third alternative embodiment of the invention in which positive pressurized air pulses are channeled into the bottom chamber 28 on the underside of a slidable piston 88, and negative pressurized air pulses are fed into the upper chamber 26 using an auxiliary conduit 90 provided with a check valve 92 for preventing escape of the negative pulses therethrough, i.e. permitting air to only escape from upper chamber 26. A leak-down conduit 94 controllably leaks the pulses into and out of each of the chambers 26, 28 by means of the needle valve 76. Positive pressurized air pulses which leak into the upper chamber 26 will escape through conduit 90 so there will always be an overall negative pressure in the upper chamber 26. The same is true for the negative pressurized air such that there will always be an overall positive pressure in the bottom chamber 28. Because the forces in the upper chamber 26 act on a greater surface area of the piston 88 than on the plunger side, the spring 42 acts as an override to prevent the piston 88 from being pulled to the end of the upper chamber 26. The spring 42 continues to force plunger 62 against lever 16 to correct the slowdown of the engine. This variation is completely sealed from atmosphere, breathing only crankcase air/air-oil, so that corrosion and contamination will not affect the reliability of the speed control 10. In addition, this design provides more power with the use of a smaller sized piston 88 because there are now pushing and pulling forces on each side thereof.

Each of the three above-described embodiments share commonality of operation in that 1) a signal or set of pulses is received through a one-way check valve 72, 92; 2) the signal acts upon a piston 80, 88 or diaphragm 24 to move an associated plunger 62 in and out; and 3) a control leak-down rate of the signal maintains desired speed. All three embodiments can be preset at a specified speed, or made to be user adjustable. For example, the spring rate is adjustable in each of the embodiments so as to vary the speed at which the forces are stable. Also, the embodiments of FIGS. 1 and 4 employ a needle valve to change the leak-down rate, again changing the point at which the forces are equal so that the desired speed is adjusted to suit.

It should be understood that the present invention provides an accurate speed control normally driven by the pulses generated in the crankcase of an internal combustion engine. The speed control is useful for a wide variety of applications employing internal combustion engines. In particular, the control has been found to be particularly beneficial in small engines or marine engines where a constant speed is required for trolling in fishing and the user can control speed without affecting engine set-up/calibration. The idle speed control varies fuel at idle and low speeds without the need for a stepper motor, or an ECM. Minimal error requirements and no electrical load place no parasitic loss upon the engine. It can also be appreciated that the use of crankcase pulses in the speed control inherently provides lubrication of the control as oil mist is present in all engine crankcases for engine bearing lubrication. With the proper selection of spring 42, seal 58, pistons 80, 88 and diaphragm 24, large forces can be made available which provide fast response. The idle speed control of the present invention provides a rugged, simple design for optimum durability. Without prohibitive cost, the idle speed control can be made from corrosion/vibration resistant materials which further improve reliability.

While the invention has been described with reference to a preferred embodiment, those skilled in the art will appreciate that certain substitutions, alterations and omissions may be made without departing from the spirit thereof. For example, it should be appreciated that the pressurized air pulses admitted into one or both chambers 26, 28 can be generated from the same cylinder in the engine or an opposing cylinder, whichever provides the best balance of reaction time and sensitivity when seal friction, conduit size and spring rates are optimized. Multiple cylinders of the engine may be plumbed into the speed control through additional conduits and check valves, creating greater force, if desired. Accordingly, the foregoing description is meant to be exemplary only, and should not be deemed limitative on the scope of the invention set forth with following claims.

I claim:

1. An idle speed control for an internal combustion engine having a crankcase adapted to be connected to a fuel metering device used to selectively deliver fuel to the engine in response to pressurized air pulses generated in the engine, the idle speed control comprising:

a pulse sensing arrangement cooperable with the fuel metering device to change engine idle speed by balancing the pressurized air pulses and a release of the pressurized air pulses relative to an opposing biasing force.

2. The idle speed control of claim 1, wherein the pressurized air pulses are generated in the crankcase of a two-cycle engine.

3. The idle speed control of claim 1, wherein the pressurized air pulses are generated in the intake manifold of a four-cycle engine.

4. An idle speed control for an internal combustion engine having a crankcase adapted to be connected to a fuel metering device used to selectively deliver fuel to the engine in response to pressurized air pulses generated in the engine, the idle speed control comprising:

a vessel having a pressure actuated member movably mounted therein to define a first chamber and a second chamber, the second chamber being provided with a biasing device acting on one side of the pressure actuated member and the first chamber admitting the pressurized air pulses acting on an opposite side of the pressure actuated member and controllably leaking a portion of the pulses therefrom, the idle speed being controlled by the leak-down rate of pressurized air pulses released from the first chamber.

5. The idle speed control of claim 4, including a first passageway for admitting positive pressurized air pulses into the first chamber, the inlet being provided with a check valve.

6. The idle speed control of claim 5, including a second passageway for admitting negative pressurized air pulses into the second chamber.

7. A pressure actuated idle speed control for an internal combustion engine including a crankcase connected with a fuel metering device assembly including an actuator used to deliver fuel at a predetermined pressure and volume responsive to pressurized air pulses generated in the crankcase, the idle speed control comprising:

a vessel for receiving the pressurized air pulses;

a pressure actuated member movably mounted in the vessel and responsive to at least one set of pressurized air pulses acting on at least one side thereof, the pressure actuated member having a plunger extending from the one side outwardly of the vessel for engagement with the fuel metering device;

a biasing device mounted in the vessel and acting on an opposite side of the pressure actuated member; and a leak-down arrangement in the vessel for releasing the pressurized air pulses therefrom, whereby when the idle speed is low, the pressurized air pulses acting on the one side of the pressure actuated member are released from the vessel via the leak-down arrangement and overcome by the biasing device which forces the plunger against the actuator to increase the fueling rate and the idle speed, and when the idle speed becomes excessively high, the pressurized air pulses acting on the one side of the pressure actuated member overcome the biasing device and withdraw the plunger from the actuator to reduce the fueling rate and the idle speed.

8. The idle speed control of claim 7, wherein the biasing force is adjustable.

9. The idle speed control of claim 7, wherein the biasing device is a spring.

10. The idle speed control of claim 7, wherein the pressure actuated member is a diaphragm.

11. The idle speed control of claim 7, wherein the pressure actuated member is a slidable piston.

12. The idle speed control of claim 11, wherein the vessel is formed with a plurality of leak-down holes selectively uncovered by sliding of the piston.

13. The idle speed control of claim 7, wherein the leak-down arrangement includes an adjustable needle valve.

14. The idle speed control of claim 7, wherein a second set of pressurized air pulses acts on the other side of the pressure actuated member.

15. A pressure actuated speed control for an internal combustion engine including a crankcase connected with a fuel metering device including an actuator used to deliver fuel at a predetermined pressure and volume responsive to pressurized air pulses generated in the crankcase, the idle speed control comprising:

a rigid vessel for receiving the pressurized air pulses;

a pressure actuated piston slidably mounted in the vessel to define a first chamber and a second chamber, the piston being responsive to a set of positive pressurized air pulses admitted into the first chamber and acting on one side of the piston, and a set of negative pressurized air pulses admitted into the second chamber and acting on an opposite side of the piston, the piston having a plunger extending from the one side outwardly of the vessel for engagement with the fuel metering device;

an adjustable spring mounted in the vessel and acting on the opposite side of the piston in the second chamber; and a leak-down conduit connecting the first chamber and the second chamber, and having a valve for controlling the flow of the pressurized air pulses therebetween.

16. A pressure actuated speed control for an internal combustion engine including a crankcase connected with a fuel metering device including an actuator used to deliver fuel at a predetermined pressure and volume responsive to pressurized air pulses generated in the crankcase, the idle speed control comprising:

a pressure actuated, flexible diaphragm movably mounted in the vessel to define a first chamber and a second chamber, the diaphragm being responsive to a set of pressurized air pulses admitted into the first chamber and acting on one side of the diaphragm, the diaphragm having a plunger extending from the one side outwardly of the vessel for engagement with the fuel metering device;

an adjustable spring mounted in the vessel and acting on the opposite side of the diaphragm in the second chamber; and a leak-down conduit extending outwardly from the vessel and having a valve for controllably releasing pressurized air pulses from the first chamber.

17. A pressure actuated speed control for an internal combustion engine including a crankcase connected with a fuel metering device including an actuator used to deliver fuel at a predetermined pressure and volume responsive to pressurized air pulses generated in the crankcase, the idle speed control comprising:

a rigid vessel for receiving the pressurized air pulses, the vessel being formed with a series of holes for controllably leaking the pressurized air pulses therefrom;

a pressure actuated piston slidably mounted in the vessel to define a first chamber and a second chamber, the piston being responsive to a set of pressurized air pulses admitted into the first chamber and acting on one side of the piston, the piston having a plunger extending outwardly of the vessel for engagement with the fuel metering device, the movement of the piston selectively covering and uncovering the holes in the vessel to control the rate of pressurized air pulses released from the first chamber; and an adjustable spring mounted in the vessel and acting on an opposite side of the piston in the second chamber.

* * * * *